US009481954B2

(12) United States Patent
Terakawa et al.

(10) Patent No.: US 9,481,954 B2
(45) Date of Patent: Nov. 1, 2016

(54) PROCESSING APPARATUS FOR HOT-AIR TREATMENT OF FIBER CONSTITUTING NONWOVEN FABRIC TO PRODUCE NONWOVEN FABRIC, AND PROCESSING PROCESS FOR THE SAME

(75) Inventors: Taiju Terakawa, Shiga (JP); Hirokazu Terada, Shiga (JP)

(73) Assignees: JNC FIBERS CORPORATION, Tokyo (JP); JNC CORPORATION, Tokyo (JP)

( * ) Notice: Subject to any disclaimer, the term of this patent is extended or adjusted under 35 U.S.C. 154(b) by 181 days.

(21) Appl. No.: 13/075,969

(22) Filed: Mar. 30, 2011

(65) Prior Publication Data

US 2011/0240210 A1 Oct. 6, 2011

(30) Foreign Application Priority Data

Apr. 2, 2010 (JP) ..... 2010-086394

(51) Int. Cl.
*B29C 65/00* (2006.01)
*D04H 1/54* (2012.01)
*D04H 1/74* (2006.01)

(52) U.S. Cl.
CPC . *D04H 1/54* (2013.01); *D04H 1/74* (2013.01)

(58) Field of Classification Search
CPC ..... D04H 1/74; D04H 1/54; D04H 1/5405; B32B 37/08; B32B 37/085; B29C 66/0342; B29C 66/349; B29C 66/8181; B29C 66/7294
USPC ..... 156/62.2, 62.4, 62.6, 62.8, 167, 176, 156/180, 308.2, 309.6, 290, 296, 43, 3, 156/436; 264/109, 115, 123, 124, 125, 126, 264/172.19; 428/407
See application file for complete search history.

(56) References Cited

U.S. PATENT DOCUMENTS 3,200,181 A 8/1965 Rudloff
4,642,153 A 2/1987 Lohr
5,974,631 A * 11/1999 Leifeld ..... D04H 1/12 156/322

(Continued)

FOREIGN PATENT DOCUMENTS

DE 197 14 348 10/1998
EP 2 039 818 3/2009

(Continued)

OTHER PUBLICATIONS

Machine translation of JP 2001003253 date unknown.*

(Continued)

*Primary Examiner* — John Goff
(74) *Attorney, Agent, or Firm* — Wenderoth, Lind & Ponack, L.L.P.

(57) ABSTRACT

A processing apparatus and a processing method capable of producing a point-through-air nonwoven fabric wherein hot air is allowed to penetrate through spots of a web or a sheet-like material and fibers at the penetration site are heat-bonded. The processing apparatus for hot-air treatment nonwoven fabric, includes: a rotating running endless belt with holes, a hot-air blowing apparatus which blows out hot air from an internal side of the endless belt with holes toward an outer side thereof, and an endless belt for fiber conveyance which is arranged on a side opposite to the hot-air blowing side of the hot-air blowing apparatus across the endless belt with holes and the endless belt for fiber conveyance rotates while the hot-air passes therethrough.

8 Claims, 11 Drawing Sheets

(56) References Cited

U.S. PATENT DOCUMENTS

| | | | | |
|---|---|---|---|---|
| 6,010,323 | A * | 1/2000 | Sekino | 425/122 |
| 2005/0064143 | A1 | 3/2005 | Bevan | |
| 2010/0237529 | A1 | 9/2010 | Bevan | |
| 2011/0126388 | A1* | 6/2011 | Takabayashi | A47L 13/16 28/104 |
| 2014/0113520 | A1 | 4/2014 | Bevan | |

FOREIGN PATENT DOCUMENTS

| | | | | |
|---|---|---|---|---|
| JP | 48-27070 | | 4/1973 | |
| JP | 57-205569 | | 12/1982 | |
| JP | 4-24263 | | 1/1992 | |
| JP | 6-158499 | | 6/1994 | |
| JP | 8-226069 | | 9/1996 | |
| JP | 08226069 | A * | 9/1996 | |
| JP | 2001-003253 | | 1/2001 | |
| JP | 2007-84958 | | 4/2007 | |
| JP | 2008-2034 | | 1/2008 | |
| JP | 4206570 | | 1/2009 | |
| TW | 200302304 | | 8/2003 | |
| WO | WO 2009145148 | A1 * | 12/2009 | A47L 13/16 |

OTHER PUBLICATIONS

Machine translation of JP 08226069 date unknown.*
Machine translation of JP 06-158499 date unknown.*
Extended European Search Report dated Jun. 8, 2011 in corresponding European Patent Application No. 11160398.
Office Action issued Jun. 26, 2015 in corresponding Taiwanese patent application No. 100111046 (with English translation).

* cited by examiner

PROCESSING APPARATUS FOR HOT-AIR TREATMENT OF FIBER CONSTITUTING NONWOVEN FABRIC TO PRODUCE NONWOVEN FABRIC, AND PROCESSING PROCESS FOR THE SAME

BACKGROUND OF THE INVENTION

1. Field of the Invention

The present invention relates to a processing apparatus for hot-air treatment of a fiber constituting a nonwoven fabric to produce the nonwoven fabric and a processing process for the same. More specifically, the invention relates to a processing apparatus and a processing method for producing a point-through-air nonwoven fabric wherein hot air is allowed to penetrate through spots of a web or a sheet-like article and fibers at the penetration sites are thermally bonded.

2. Description of the Related Art

As methods for bonding between fibers for nonwoven fabric production, a thermal bonding method, a chemical bonding method, a needle punching method, a water-stream entangling method and the like are generally known. As processing methods for the general thermal bonding method, a hot-air through-air processing method and a hot-roll press-fixing processing method are known.

The hot-air through-air processing method is a method wherein a heat-bondable conjugate fiber comprising a low-melting component and a high-melting component is used as a web and hot air at a temperature of the low melting point or higher and the high melting point or lower is allowed to penetrate. A nonwoven fabric obtained by this method has both of bulkiness and strength but has a drawback in that flexibility is impaired since fiber-entangling points are wholly heat-bonded.

The hot-roll press-fixing processing method is a method wherein press-processing is performed with a pair of two hot rolls. A nonwoven fabric obtained by this method has high strength but there is a drawback in that bulkiness and flexibility are impaired. As a method which overcomes the drawback, a point-bonding heat-press-fixing processing method is exemplified. However, even by this method, it is difficult to obtain sufficient bulkiness.

Accordingly, in order to provide bulkiness and flexibility to a nonwoven fabric together with sufficient strength, there has been used a point-through-air processing method wherein regions through which hot air is allowed to penetrate and regions with which hot air is not brought into contact are mixed on a heat-bondable conjugate fiber web and the web is processed. As described in Japanese Patent No. 4206570, the processing method of a point-through-air nonwoven fabric is a processing method utilizing a hot-air processing machine (suction band dryer). Specific examples include a method comprising placing a heat-bondable conjugate fiber web on a conveyer net of the hot-air processing machine, inserting a spacer so as not to crush the bulkiness of the web as far as possible, sandwiching it between punching boards, and treating it with hot air at a low velocity; a method comprising changing the conveyer of the hot-air processing machine to a porous one, placing a fiber web thereon, and treating the web with hot air; and a method comprising using a hot-air processing machine having porous conveyers above and below, sandwiching a web, and treating it with hot air.

In the case where a nonwoven fabric is formed by such a point-through-air processing method, since hot air is passed through the punching board to penetrate through the heat-bondable conjugate fiber web, the heat-bonded parts where fibers are bonded by heat is interspersed in the nonwoven fabric. Since the heat-bondable conjugate fibers are bonded to one another in the heat-bonded part regions, strength can be provided to the nonwoven fabric. On the other hand, bulkiness and flexibility can be provided by non-heat-bonded part regions to which hot air was not applied.

SUMMARY OF THE INVENTION

The conventional hot-air processing machine is a so-called suction band dryer and has a structure where a conveyer is surrounded by a thermal treatment chamber. Therefore, the thermal treatment chamber necessarily becomes a large one and hence treating time is also prolonged. In the case where the treating time is long or in the case where hot-air temperature is much higher than the melting point of the fiber, as shown in FIGS. 6 and 7, by the influence of hot air and the heat from the punching board, on the border between the heat-bonded part 11 and the non-heat-bonded part 12, a mixed part 15 where both parts are mixed each other is generated. In the case where a hot-air blowing rate is small or in the case where fiber density of the fiber web to be processed is high, straight advancing properties of the hot air is impaired and therefore the hot air is diffused. Namely, as shown in FIGS. 8 and 9, since the hot air reaches the conveyer net in a diffused state, the thermal treatment is completely carried out at the parts close to the conveyer net. To the contrary, in the case where the diffused hot air does not reach the conveyer net, no thermal treatment is carried out at the parts close to the conveyer net. Furthermore, in the case of exceedingly high temperature, as shown in FIGS. 10 and 11, the fibers are bonded all over the whole surface of the nonwoven fabric surface on the conveyer net side, and there is a possibility that the non-heat-bonded part 12 becomes absent. To the contrary, in the case where the hot air temperature is about the same as the melting temperature of the synthetic fiber, the fibers are not bonded all over the whole surface of the nonwoven fabric surface on the conveyer net side, and thus a point-through-air nonwoven fabric wherein heat-bonded parts of the fibers are formed cannot be obtained in some cases.

Moreover, in the case where the thermal treatment chamber is large, it is difficult to maintain the penetration rate of hot air homogeneously all over the whole surface. Therefore, sometimes it is impossible to keep the quality uniform when the machine is used as a production machine.

Furthermore, since the punching board should be sequentially set in accordance with the movement of the conveyer net at the hot-air processing, the conventional point-through air processing method takes significant amount of time and labor.

In view of the above problems, the present invention provides a processing apparatus for hot-air treatment nonwoven fabric capable of manufacturing a nonwoven fabric wherein fibers are partly heat-bonded, both bulkiness and flexibility are provided, and fibers other than those at the heat-bonded parts do not lose their function and capable of being utilized as a production machine, as well as a processing method capable of manufacturing the nonwoven fabric. Furthermore, the invention provides an apparatus and a method capable of continuously producing a nonwoven fabric having a stable quality, although an apparatus for hot-air penetration is compact.

The processing apparatus for hot-air treatment nonwoven fabric can easily produce a point-through-air nonwoven fabric wherein fibers are partly heat-bonded by holding a web or a sheet-like material comprising synthetic fibers between an endless belt with holes and an endless belt for fiber conveyance, and passing hot air from a hot-air blowing apparatus through the holes of the endless belt with holes to penetrate through the web or sheet-like material. Since the endless belt with holes and the endless belt for fiber conveyance rotate and run, they enable continuous production. Moreover, since it is not necessary to sequentially set a punching board in the case of using the endless belt with holes, working efficiency can be improved. Furthermore, since the hot-air blowing apparatus is arranged on an internal side of the endless belt with holes, it is not necessary to cover the whole conveyer with the thermal treatment chamber. Accordingly, the processing apparatus for hot-air treatment nonwoven fabric can be made compact.

Moreover, since the distance between the belt surfaces of the endless belt with holes and the endless belt for fiber conveyance can be arbitrarily adjusted, it is possible to control the thickness of a nonwoven fabric to be produced.

Furthermore, according to the processing apparatus for hot-air treatment nonwoven fabric of the invention can produce a point-through-air nonwoven fabric wherein the synthetic fibers at the parts through which the hot air is allowed to penetrate are heat-bonded as tubular films or minute clots near the penetration parts and a point-through-air nonwoven fabric wherein intersecting points of the fibers are heat-bonded, by allowing hot air to penetrate at a temperature equal to or higher than the melting point of the synthetic fiber constituting the web or sheet-like material.

In addition, the processing apparatus for hot-air treatment nonwoven fabric of the invention can be used as an apparatus for the thermal treatment such as annealing by allowing hot air to penetrate or applying hot air at a temperature lower than the melting point of the synthetic fiber constituting the web or sheet-like material.

REFERENCE SIGNS LIST

Figure 1:
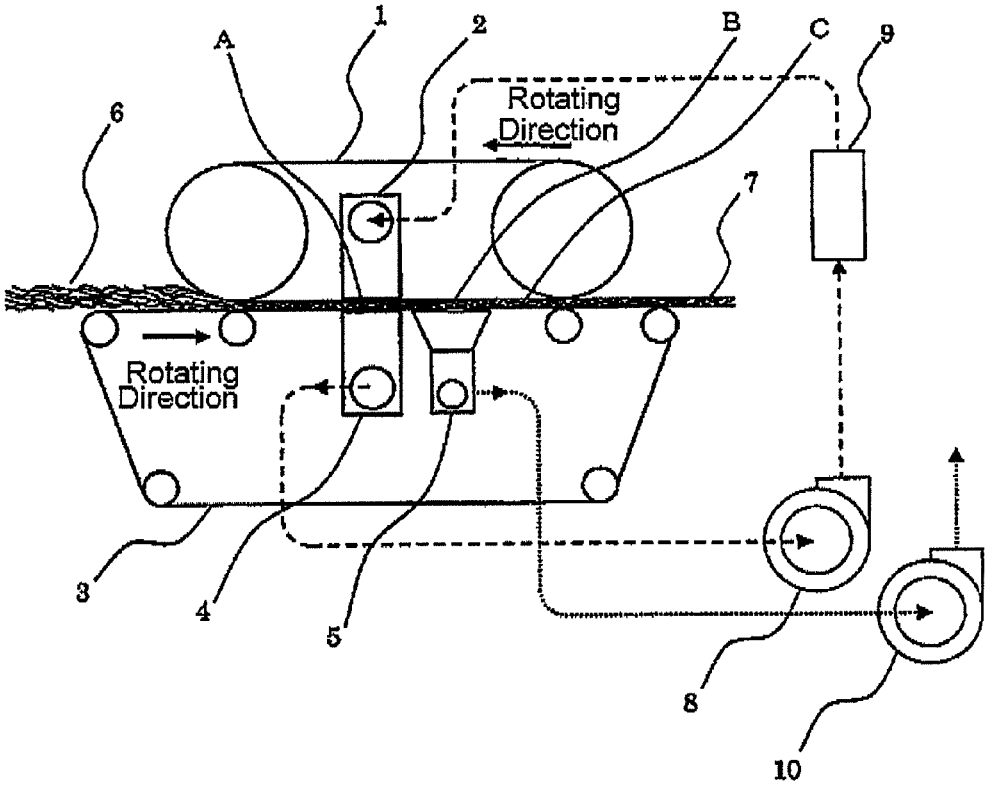
FIG. 1 is a lateral schematic view of the whole processing apparatus for hot-air treatment nonwoven fabric of the invention.

1 Endless belt with holes
2 Hot-air blowing duct (hot-air blowing apparatus)
3 Endless belt for fiber conveyance
4 Hot-air sucking duct (hot-air sucking apparatus)
5 Cooling-air sucking duct (cooling apparatus)
6 Fiber web
7 Point-through-air nonwoven fabric
8 Hot-air circulating fan
9 Air heater
10 Exhaust fan
11 Heat-bonded part
12 Non-heat-bonded part
13 Upper layer part
14 Lower layer part
15 Mixed part of heat-bonded part and non-heat-bonded part
A Web at heat-bonded part
B Web at non-heat-bonded part
C Partly thermally-bonded web

DETAILED DESCRIPTION OF THE INVENTION

Namely, the present invention relates to the following:

(1) A processing apparatus for hot-air treatment nonwoven fabric, comprising:

a rotating running endless belt with holes, a hot-air blowing apparatus which blows out hot air from an internal side of the endless belt with holes toward an outer side thereof, and an endless belt for fiber conveyance which is arranged on a side opposite to the hot-air blowing side of the hot-air blowing apparatus across the endless belt with holes and rotates with passing the hot-air therethrough;

(2) The processing apparatus for hot-air treatment nonwoven fabric described in the above (1), further comprising a hot-air sucking apparatus which sucks a part or all amount of the hot air supplied from the hot-air blowing apparatus on an internal side of the endless belt for fiber conveyance;

(3) The processing apparatus for hot-air treatment nonwoven fabric described in the above (1) or (2), wherein the endless belt with holes and the endless belt for fiber conveyance has a distance which is freely controllable in the range of 0.1 to 20 mm;

(4) The processing apparatus for hot-air treatment nonwoven fabric described in any one of the above (1) to (3), wherein the endless belt with holes has an open area ratio of 60% or less;

(5) The processing apparatus for hot-air treatment nonwoven fabric described in any one of the above (1) to (3), wherein the endless belt with holes has an open area ratio of 10 to 40%;

(6) The processing apparatus for hot-air treatment nonwoven fabric process described in any one of the above (1) to (5), wherein the hot-air blowing apparatus has a CV value of hot-air blowing rate of 12% or less;

(7) The processing apparatus for hot-air treatment nonwoven fabric described in any one of the above (1) to (6), further comprising a cooling apparatus which cools the endless belt with holes;

(8) A method for processing point-through-air nonwoven fabric, comprising penetrating hot air through at least one layer of a web or a sheet-like material which comprises at least one synthetic fiber for a thermal treatment using the processing apparatus for hot-air treatment nonwoven fabric described in any one of the above (1) to (7);

(9) The method for processing point-through-air nonwoven fabric described in the above (8), wherein the hot air is equal to or higher than the lowest melting point among the synthetic fibers;

(10) The method for processing point-through-air nonwoven fabric described in the above (8) or (9), wherein at least one kind of the synthetic fibers is a conjugate fiber comprising two or more components different in melting point; and

(11) The method for processing point-through-air nonwoven fabric described in any one of the above (8) to (10), wherein time for the treatment to penetrate hot air through the web or sheet-like material is from 0.1 to 10 seconds.

The embodiments of the invention are described below with reference to the drawings.

FIG. 1 is a lateral schematic view of the whole apparatus which is exemplified in order to illustrate the processing apparatus for hot-air treatment nonwoven fabric of the invention. The processing comprises an endless belt with holes 1, a hot-air blowing duct (hot-air blowing apparatus) 2, an endless belt for fiber conveyance 3, a hot-air sucking duct (hot-air sucking apparatus) 4, a cooling-air sucking duct (cooling apparatus) 5, a hot-air circulating fan 8, an air heater 9, and an exhaust fan 10.

As shown in FIG. 1, the hot-air blowing duct 2 is arranged on an internal side of the endless belt with holes 1 mounted on a rotating roll, and an endless belt for fiber conveyance 3 mounted on a rotating roll is arranged at a side opposite to the hot-air blowing side of the hot-air blowing duct 2 across the endless belt with holes 1 at a predetermined distance from the endless belt with holes 1. The hot-air sucking duct 4 is arranged on an internal side of the endless belt for fiber conveyance 3 in a position opposed to the hot-air blowing duct 2, and the cooling-air sucking duct 5 is arranged on a downstream side of the hot-air sucking duct 4, namely, on the rotating direction side of the belt. The hot-air circulating fan 8 and the air heater 9 are connected to the hot-air sucking duct 4 and the hot-air blowing duct 2 with a connecting duct, and the exhaust fan 10 is connected to the cooling-air sucking duct 5 with a connecting duct.

In FIG. 1, a fiber web (heat-bondable conjugate fiber web) 6 is supplied from the left side, conveyed to the right side in a condition of being held between the endless belt with holes 1 and the endless belt for fiber conveyance 3, both of which rotate to run at the same speed, and subjected to a hot-air treatment in the middle of conveyance to form a point-through-air nonwoven fabric 7. That is, the hot air supplied from the hot-air blowing duct 2 is applied to the fiber web 6 through the holes of the endless belt with holes 1; synthetic fibers are melted mainly at the positions of the holes of the endless belt with holes 1 (web A at hot-air treatment parts) and are cooled in the cooling-air sucking duct 5; the intersecting points of the fibers that are melted and bonded in the web passing through the cooling-air sucking duct 5 (web B at cooling treatment parts) are gradually solidified as the web's running; the melted parts of the fiber in the web, which reaches near an exit (partly heat-bonded web C), are completely solidified to form a partly heat-bonded point-through-air nonwoven fabric 7.

In the processing apparatus of the invention, the hot air penetrating from the web A at the hot-air treatment parts is sucked from the hot-air sucking duct 4 by the hot-air circulating fan 8 and is continuously sent to the hot-air blowing duct 2 to circulate the hot air. Furthermore, the air heater 9 is provided in the middle of the circulating path of the hot air to control the temperature of the hot air to a temperature equal to or higher than the melting point of the synthetic fiber.

Also, the cooling-air sucking duct 5 provided on the downstream side of the hot-air sucking duct 4 is connected to the exhaust fan 10, and the atmospheric air penetrates through the endless belt with holes 1. The web B at the cooling treatment parts and the endless belt for fiber conveyance 3 sequentially force each part and member to cool. The air is then sucked from the sucking port, and exhausted outside.

Next, the facility conditions and actions of each part are described in detail.

Each of the endless belt with holes 1 and the endless belt for fiber conveyance 3 is mounted on rotating rolls. Each running speed is almost the same. It is possible to stably perform processing of the hot-air treatment since the running at the same speed enables no transversal deviation of the fiber constituting the fiber web 6 and no positional deviation of the parts to be subjected to the hot-air treatment. Furthermore, it is possible to control quality change of the fiber constituting the point-through-air nonwoven fabric 7 other than the parts subjected to the hot-air treatment parts. A driving source may be connected to the rolls on which each belt has been mounted, or transmitted from either one driving source.

(Endless Belt with Holes)

The endless belt with holes 1 is a belt formed to be a circular plate material having a necessary length or formed to be endless in a running direction (hereinafter referred to as MD) by connecting both end parts wherein small holes are made almost all over the whole surface of the belt. The length of the belt in MD and the length in a width direction (hereinafter referred to as CD) are not particularly limited. Basically, as long as the functions described in the present specification are satisfied, it is preferred that the lengths in MD and CD are small from the viewpoint of downsizing the processing apparatus. That is, the length in MD may be one which is sufficient to incorporate the individual apparatus explained in the present application and the width in CD may be one which is sufficient to process the largest width of a desired product without problems.

In the invention, the open area ratio of the holes of the endless belt with holes 1 is preferably 60% or less, more preferably 10 to 40%. When the open area ratio is 60% or less, the ratio of the heat-bonded parts where the fibers are bonded to each other in the point-through-air nonwoven fabric 7 is not exceedingly large and the ratio of the non-heat-bonded parts is not exceedingly small. Therefore, when the ratio is 60% or less, since the ratio is kept in an appropriate range, the point-through-air nonwoven fabric 7 becomes rich in flexibility. Also, the fibers at the non-heat-bonded parts, namely, the fibers other than the heat-bonded parts can exhibit the functions sufficiently. Accordingly, by controlling the open area ratio to 60% or less, a point-through-air nonwoven fabric 7 can be formed with bulkiness and flexibility and maintain functions of the fibers other than the heat-bonded parts in good balance.

Moreover, from the viewpoint of mechanical factors, the open area ratio of the endless belt with holes 1 is preferably 60% or less. When the open area ratio is 60% or less, an apparatus can have sufficient strength and distortion resistance and endure a long-term use as a production apparatus.

In the invention, the thickness of the endless belt with holes 1 is not particularly limited but is preferably 0.3 to 2 mm. When the thickness of the endless belt with holes 1 is 0.3 mm or more, the belt is excellent in distortion resistance. When the thickness is 2 mm or less, the belt can have sufficient flexibility to fit the rotating roll.

Moreover, in the invention, the raw material of the endless belt with holes 1 is not particularly limited. However, from the mechanical viewpoint and the viewpoint of nonwoven fabric processability as a production apparatus, it is necessary to possess thermal resistance, thermal distortion resistance, and rust resistance together with high strength and distortion resistance. Also, the raw material preferably has smoothness as much as possible. Preferable examples of the raw material for the belt include a stainless steel plate, an iron plate subjected to a hard chromium-plating treatment and the like.

Furthermore, in the invention, the shape of the hole and area per one hole of the endless belt with holes 1 are not particularly limited and may be suitably selected in consideration of the thickness of the fiber web to be processed. In addition, the layout of the holes is not particularly limited. However, when the area per hole is extremely large, the obtained nonwoven fabric may be out of the criteria of partial heat-bonding. Moreover, when there is a region where the distance between holes is large, the region may still remain as a web. Therefore, it is impossible to form a nonwoven fabric. That is, the holes of the endless belt with holes 1 may be circular ones, elliptical ones, triangular ones, square ones, rectangular ones, hexagonal ones, amorphous ones, and mixtures thereof and also are preferably located almost uniformly all over the whole surface of the belt as far as possible.

(Hot-Air Blowing Duct)

The hot-air blowing duct 2 is a hot-air blowing apparatus in the invention. The hot-air blowing duct 2 is arranged close to an internal side of the endless belt with holes 1 and the hot-air blowing face of the hot-air blowing duct 2 is located on the web A side at the hot-air treatment part. The distance between the endless belt with holes 1 and the hot-air blowing duct 2 is preferably within 5 mm. By controlling the distance within 5 mm, hot air can be surely allowed to penetrate through the web A at the hot-air treatment part. In addition, the distance between the hot-air blowing face of the hot-air blowing duct 2 and the internal side of the endless belt with holes 1 can be arbitrarily set by mounting the hot-air blowing duct 2 on a body supporting the endless belt with holes 1 and the rotating rolls on which the belt is mounted in an integrated fashion and providing a mechanism which can control the distance of the mounted portion and the body. Moreover, in order to enhance the efficiency of hot air penetration, a frame material having a small frictional resistance may be attached onto an outer frame of the hot-air blowing face as a part of the hot-air blowing apparatus and may be arranged so as to be in contact with the internal side of the endless belt with holes 1.

The length in MD of the hot-air blowing face of the hot-air blowing duct 2 is not particularly limited. However, it is necessary to decide the length in MD in view of the uniformity of the hot-air blowing rate, the compactness of the apparatus itself and the productivity. For example, in the case where the unit weight of the point-through-air nonwoven fabric 7 to be produced is small, it is preferable to set the running rate of the endless belt with holes 1 high so as to shorten the passing time of the web A at the hot-air treatment part through the hot-air blowing duct 2. To the contrary, in the case where the unit weight of the point-through-air nonwoven fabric 7 to be produced is large, it is preferable to set the running speed of the endless belt with holes 1 low so as to extend the passing time.

However, in view of the components constituting the fiber web 6 and the qualities such as unit weight, thickness, degree of heat-bonding, strength, and texture of the point-through-air nonwoven fabric 7, it is more preferable to design the apparatus so as to control the length in MD of the hot-air blowing face in addition to the processing conditions, such as the above-mentioned running speed of the belt and distance between the endless belt with holes 1 and the endless belt for fiber conveyance 3, the hot-air blowing rate and hot-air temperature to be mentioned later. Examples of the method include a method where the part of the hot-air blowing face of the hot-air blowing duct 2 is designed to be separable, various kinds of the part different in the length in MD are assorted and the parts having the necessary length is selected and mounted; a method where a sliding damper from the upstream and downstream sides of the hot-air blowing face or either side thereof is mounted and the length is adjusted to the necessary length; and the like.

The length in CD of the hot-air blowing face of the hot-air blowing duct 2 is not particularly limited. Basically, the length may be adjusted so as to be one equivalent to the maximum width of the point-through-air nonwoven fabric 7 to be produced. However, when the width of the point-through-air nonwoven fabric 7 to be produced is small, it is important to adjust the length in CD to the width. That is, if the length in CD of the hot-air blowing face is too large relative to the width of the web A at the hot-air treatment part which passes through the site, the hot air tends to flow to both side portions where the web A is not present. As a result, unevenness occurs in the temperature of the hot air penetrating through the web A. The occurrence of the unevenness becomes remarkable in the case where the unit weight and bulk density of the point-through-air nonwoven fabric 7 to be produced are large. In this regard, the control of the width in CD may be performed by a method wherein the aforementioned method of controlling the length in MD is applied to CD and developed.

The hot-air blowing rate of the hot-air blowing face of the hot-air blowing duct 2 is not particularly limited. However, a deviation range of the rate is regulated so as to be preferably 12% or less and more preferably 8% or less in terms of a CV value. The definition of the CV value is a variation coefficient of wind velocity. Specially, the value is represented as a percentage which is obtained by dividing standard deviation of each wind velocity by the average velocity thereof wherein the wind velocity is the wind velocity at each intersection points on an imaged grid resulting from sectioning of the whole blowing face from the central part in the directions of MD and CD at intervals of 10 cm. By controlling the CV value to 12% or less, it becomes possible to produce a qualitatively stable nonwoven fabric.

In the invention, in order to enhance uniformity of the hot-air blowing rate in CD, an air-inner-pressure elevating apparatus and the like may be provided between the air inlet and the hot-air blowing face of the hot-air blowing duct 2. The air-flow-path controlling apparatus, an air-inner-pressure elevating apparatus and the like are effective for decreasing the CV value. They are not particularly necessary in the case where the CD length of the nonwoven fabric to be produced is small; the bulk density is small; or the open area ratio of the endless belt with holes 1 is small. However, it effectively acts in the case where the CD length of the nonwoven fabric to be produced is large; the bulk density is large; or the open area ratio of the endless belt with holes 1 is large.

(Endless Belt for Fiber Conveyance 3)

The endless belt for fiber conveyance 3 is a belt formed to be a circular plate material having a necessary length or formed to be endless in a running direction (hereinafter referred to as MD) by connecting both end parts wherein openings capable of passing the hot air supplied from the hot-air blowing duct 2 are provided. The MD length and CD length of the endless belt for fiber conveyance 3 are not particularly limited. Basically, as long as the functions described in the present specification are satisfied, a smaller one is preferred from the viewpoint of downsizing the processing apparatus for hot-air treatment nonwoven fabric of the invention.

The endless belt for fiber conveyance 3 exemplified in the invention is one wherein a fibrous material is formed into a net-like belt by weaving or knitting. The shape, size and the like of the openings are not particularly limited as long as the fiber web 6 can be placed and conveyed and the hot air supplied from the hot-air blowing duct 2 can be allowed to penetrate in the blowing direction, i.e., in the thickness direction of the web A at the hot-air treatment part to be passed through the hot-air blowing duct 2 without blocking the flow path.

With regard to the fibrous material to be used for the endless belt for fiber conveyance 3, the raw material and the fiber diameter are not particularly limited. Also, with regard to the net state, the mode of weaving or knitting, the open area ratio and the like are not particularly limited. However, characteristics such as strength and thermal resistance for enduring against use, flexibility for following the rotating roll, and air permeability for permeating hot air efficiently are required for the endless belt for fiber conveyance 3. Accordingly, it is necessary to select the fibrous material and the net state so that the necessary characteristics are satisfied.

For example, as a raw material for the fibrous material, polyesters are used when the operating temperature is about 150° C. or less and aromatic polyamides and further stainless steel are used when the operating temperature is more than 150° C. With regard to the fiber diameter and the mode of weaving or knitting, in view of strength, flexibility and air permeation, a material is preferably performed plain weaving or twill weaving using a fiber having a diameter of about 0.5 to 1.5 mm is preferred. A larger open area ratio is preferable in view of securing the permeability of hot air. In view of a balance between the open area ratio of the endless belt with holes 1 and the belt material; and the diameter and the mode of weaving or knitting of the belt material, the open area ratio is preferably 30 to 80%.

The endless belt for fiber conveyance 3 is arranged at a side opposite to the hot-air blowing side of the hot-air blowing duct 2 across the endless belt with holes 1 while providing a predetermined distance. The distance between the endless belt with holes 1 and the endless belt for fiber conveyance 3 may be a smaller distance than the thickness of the fiber web 6 to be conveyed. For example, the distance is preferably freely controlled in the range of 0.1 to 20 mm. It is preferable that the distance between the endless belt with holes 1 and the endless belt for fiber conveyance 3 is 0.1 mm or more, since the bulkiness of the nonwoven fabric is sufficiently obtained. Also, when the distance between the belts is 20 mm or less, partial heat-bonding of the fiber web can be performed since the hot air partly penetrates.

By controlling the distance between the belts, the thickness of the resulting point-through-air nonwoven fabric 7 can be arbitrarily and easily set. As a controlling method, the control can be realized by using a mechanism having a body integrally supporting the endless belt with holes 1 and the rotating rolls on which the belt has been mounted and an opposing body integrally supporting the endless belt for fiber conveyance 3 and the rotating rolls on which the belt has been mounted are separately prepared and both bodies or one body can be moved in a distance-controlled fashion against the belt surfaces opposing each other; and using a mechanism for controlling the interval between the bodies. Examples of the mechanism for the movement in a distance-controlled fashion include a jack-motor method, a hydraulic cylinder method, an air cylinder method and the like. Examples of the mechanism for controlling the interval include a set pin stopper method capable of freely controlling the length, a position controlling method by a limiter or an optical sensor, and the like.

(Hot-Air Sucking Duct)

The hot-air sucking duct 4 is a hot-air sucking apparatus in the invention. The hot-air sucking duct 4 is arranged on an internal side of the endless belt for fiber conveyance so that the hot-air sucking face of the hot-air sucking duct 4 faces the web A at the hot-air treatment part and the hot-air sucking face is close to or in contact with the internal side of the endless belt for fiber conveyance 3. Moreover, the hot-air sucking duct 4 is arranged so as to be opposite to the blowing face of the hot-air blowing duct 2 across the web A. Therefore, the hot-air sucking duct 4 sucks the hot air which is supplied from the hot-air blowing duct 2 and penetrated through the endless belt with holes 1, the web A, and the endless belt for fiber conveyance 3.

The MD and CD lengths of the hot-air sucking face of the hot-air sucking duct 4 are not particularly limited. As mentioned later, the processing apparatus for hot-air treatment nonwoven fabric has a mechanism of circulating hot air. In order for the hot air to be circulated efficiently, it is preferred to minimize the introduction of air outside the apparatus which is required for fine control of the hot-air velocity and the hot-air temperature. Usually, the length may be equal to or slightly larger than the length of the hot-air blowing face of the hot-air blowing duct 2. In this regard, the control of the MD and CD lengths may be performed by a method wherein the above method of controlling the MD and CD lengths of the hot-air blowing face of the hot-air blowing duct 2 is applied and developed.

(Hot-Air Circulating Fan 8 and Air Heater 9)

Also, the processing apparatus for hot-air treatment nonwoven fabric exemplified in the invention possesses the hot-air circulating fan 8 and the air heater 9. The hot-air circulating fan 8 supplies blowing air to the hot-air blowing duct (hot-air blowing apparatus) 2 and sucks air from the hot-air sucking duct (hot-air sucking apparatus) 4. The air heater 9 is an apparatus for heating the sucked hot air. The air-blowing port of the hot-air circulating fan 8 and the air inlet of the hot-air blowing duct 2 are connected with a dedicated connecting duct via the air heater 9. Also, the air outlet of the hot-air sucking duct 4 and the air-sucking port of the hot-air circulating fan 8 are connected with a dedicated connecting duct.

The air supplied by the hot-air circulating fan 8 is heated to a predetermined temperature by the air heater 9 and is supplied to the hot-air blowing duct 2. Then, as mentioned above, the hot air supplied from the blowing face of the hot-air blowing duct 2, penetrates the web A at the hot-air treatment part, and is sucked from the sucking port of the hot-air sucking duct 4. Thereafter, the hot air is sucked from the air outlet of the hot-air sucking duct 4 to the air sucking port of the hot-air circulating fan 8 and the hot air is circulated while maintaining the predetermined temperature by the repetition thereof. By continuously supplying the fiber web 6 thereto, it becomes possible to produce the point-through-air nonwoven fabric 7 wherein the fiber is partly heat-bonded.

The hot-air circulating fan 8 can control the circulating amount per unit time by regulating the speed of the fan and accordingly the amount of the hot air passing through the web A at the hot-air treatment part can be inevitably controlled. Moreover, the air heater 9 can be set at a predetermined temperature and the temperature can be set depending on the melting point of the synthetic fiber constituting the fiber web 6.

In the example of the invention, the connecting duct is arranged so that the hot air is circulated. However, it is not necessary for the processing apparatus for hot-air treatment nonwoven fabric to have the circulating mechanism as mentioned above. That is, a hot-air blowing mechanism in which a fan dedicated to hot-air blowing is connected to the hot-air blowing duct via an air heater and a hot-air sucking mechanism in which a fan dedicated to hot-air sucking is connected to a hot-air sucking duct may be independent from each other. In addition, only the hot-air blowing mechanism may be used when it has an ability to allow the hot air to penetrate through the web A and the hot-air sucking mechanism may not be necessary.

From the viewpoint of efficient use of the hot air, it is desirable to make use of the hot-air circulating mechanism. However, by making the hot-air blowing mechanism independent as mentioned above, it is possible to change the fan dedicated to hot-air blowing as a source for generating hot air into compressed air supplied by a compressor or the like. It is also possible to use pressurized steam in some cases. The hot-air blowing rate in these cases can be controlled by pressure control or flow control of air. However, even in these cases, the air heater 9 is necessary from the viewpoint of temperature control, quality maintenance, and stable production.

(Cooling-Air Sucking Duct)

The processing apparatus for hot-air treatment nonwoven fabric exemplified in the invention also possesses the cooling-air sucking duct 5 on the downstream side of the hot-air blowing duct (hot-air blowing apparatus) 2. The cooling-air sucking duct 5 cools the endless belt with holes 1 heated by the hot-air blowing duct 2 on the upstream side. In the case where the endless belt with holes 1 is insufficiently cooled, the residual heat of the endless belt with holes 1 itself influences the stability of the melted state of the synthetic fiber constituting the web A at the hot-air treatment part of the hot-air blowing duct 2 and thus continuous homogeneous point-through-air processing cannot be performed.

(Exhaust Fan)

To the air outlet of the cooling-air sucking duct 5, an air sucking port of the exhaust fan 10 is connected with a dedicated connecting duct. By running the exhaust fan 10, the cooling air penetrates through the holes of the endless belt with holes 1, the web B at the cooling treatment part, and the openings of the endless belt for fiber conveyance 3 and is sucked from the cooling-air sucking port of the cooling-air sucking duct 5 and exhausted from the exhaust port of the exhaust fan 10. The rate of the cooling air can be controlled by varying the speed of the exhaust fan.

The cooling air exemplified in the invention is not forcibly cooled air but is atmospheric air located near the belt surface of the endless belt with holes 1 which is an opposite side of the cooling-air sucking port of the cooling-air sucking duct 5. The MD length of the cooling-air sucking port is not particularly limited as long as the purpose is achieved. Moreover, the cooling site is any place as long as it is close to the endless belt with holes 1. In this regard, the cooling method of the example is a cooling-air sucking method but the cooling method may be a cooling-air blowing method.

In the invention, if the absence of the cooling apparatus does not influence the production of the point-through-air nonwoven fabric 7, the cooling apparatus is not necessarily applied. For example, a method for spontaneous cooling due to extension of the length of the belt may be applied. However, in order to downsize the apparatus, it is preferable that the apparatus of the invention has a forced-air-cooling apparatus that supplies air at a temperature lower than the atmospheric temperature for further enhancing the cooling effect.

As indicated in the present example of the invention, by placing the cooling-air sucking duct 5 at an immediately near downstream part of the hot-air treatment part and at the internal side of the endless belt for fiber conveyance 3, solidification of the synthetic fiber melted part of the web B at the cooling treatment part after passing through the hot-air blowing duct 2 can be promoted, together with the cooling of the endless belt with holes 1. Accordingly, it is possible to further downsize the apparatus.

By using the processing apparatus for hot-air treatment nonwoven fabric mentioned above, the fiber web 6 runs while being held between the endless belt with holes 1 and the endless belt for fiber conveyance 3, and a part or all of the synthetic fiber constituting the fiber web 6 is melted by hot air from the hot-air blowing duct 2 (web A at the hot-air treatment part) and solidified at the cooling-air sucking duct 5 (web B at the cooling treatment part). At the place where the running in the state of being held between two belts is finished and the partly heat-bonded web C is formed, the fibers which have already formed a partly heat-bonded nonwoven fabric are removed from the apparatus to be the point-through-air nonwoven fabric 7.

(Fiber Web)

The fiber web 6 to be used in the present application is a synthetic fiber. Examples of main raw material of the synthetic fiber include thermoplastic resins such as polyethylene, polypropylene, polyethylene terephthalate, Nylon 6, Nylon 66 and polyacrylonitrile. Moreover, the raw material may be so-called biodegradable resins, so-called thermoplastic elastomer resins, and the other copolymer resins, as long as they have thermoplastic properties.

The constitution of the thermoplastic resin in cross-section of the synthetic fiber is not particularly limited. Examples thereof include a single cross-section fiber using the above thermoplastic resin as a main raw material, a single cross-section fiber where an auxiliary raw material is mixed into the thermoplastic resin, and a conjugate fiber comprising at least two components of these thermoplastic resins. In this regard, the conjugate fiber comprising two components is preferably a so-called heat-bondable conjugate fiber comprising a low-melting component and a high-melting component and a part of the low-melting component forms the fiber surface. In any fibers, the cross-sectional shape, fineness, and the like are not particularly limited.

The fiber web 6 may be constituted by one kind of the synthetic fiber comprising the above raw material and the above cross-section or may be constituted as a mixture of two or more kinds of the synthetic fibers in an almost completely dispersed state. The temperature of hot air to be allowed to penetrate through the fiber web 6 comprising such a synthetic fiber at the hot-air blowing duct 2 may be a temperature higher than the lowest melting point among the melting points of the synthetic fibers constituting the web.

For example, in the case where the fiber web 6 comprises the synthetic fiber of one kind of the above conjugate fiber and the penetration temperature of the hot-air is higher than the lowest melting point and lower than the highest melting point, since only the low-melting component is melted and solidified at the hot-air treatment part, a heat-bonded structure by the low-melting component is formed at the intersection points of the fibers which remain as fibrous ones.

Also in the case where the fiber web 6 comprises at least two kinds of synthetic fibers selected from a single cross-section fiber comprising the above thermoplastic resin as a main raw material, a single cross-section fiber where an auxiliary raw material is mixed into the thermoplastic resin and the above conjugate fiber; and the penetration temperature of the hot-air is higher than the lowest melting point among those of the fiber groups used and lower than the highest melting point, as above, a heat-bonded structure by the low-melting component is formed at the intersecting points of the fibers which remain as fibrous ones.

Moreover, in the case where the hot-air temperature is higher than the highest melting point temperature of the synthetic fiber constituting the fiber web 6, the fiber at the hot-air treatment part is melted and heat-bonded in a state where the fibrous shape is lost. Example of the heat-bonded in the state where the fibrous shape is lost include the formation of the heat-bonded structure is formed as melted clots at a part of the hot-air treatment part or holes are formed at the hot-air treatment part and the heat-bonded structure is formed as films at the periphery of the holes.

The process for producing the fiber web 6 is not particularly limited as long as it is a process capable of forming the synthetic fiber into a web shape. Examples thereof include a carding method and dry pulp method for forming a web from short fibers; a spun bond method for forming a web from long fibers: and a melt-blown method for forming a web from fibrous ones obtained by blowing a melted resin with hot air or the like. The web obtained by these methods may be processed in a state of a single layer. And the webs may be obtained by the same kind of method or by the same kind of method and by a different method, and then processed in a state of a multilayer web of two or more layers laminated.

The connection between the apparatus for producing the fiber web 6 and the processing apparatus for hot-air treatment nonwoven fabric may be so-called in-line where both of them are sequentially arranged or so-called off-line where both ones are separated. In the case where two or more layers are laminated, all may be in-line or may be off-line where the webs are laminated beforehand. Moreover, the line may be a line where an in-line part and an off-line part are mixed.

By selecting the process for producing the fiber web 6, the kind of the synthetic fiber constituting the fiber web 6, the distance between the endless belt with holes 1 and the endless belt for fiber conveyance 3, the open area ratio of holes of the endless belt with holes 1 and processing conditions such as the hot-air temperature, hot-air velocity, and passing time at the hot-air treatment site, it is possible to produce various kinds of the point-through-air nonwoven fabric 7.

In the invention, the hot-air penetration treatment time performed in the processing method in the processing apparatus for hot-air treatment nonwoven fabric is not particularly limited. However, the time is preferably from 0.1 to 10 seconds, and more preferably from 0.3 to 8 seconds. The hot-air treatment time is a time for passing the fiber web 6 through the hot-air blowing duct (hot-air blowing apparatus) 2, and the time is necessary to control in view of the relation between the unit weight and the density of the point-through-air nonwoven fabric 7 to be produced, the relation between the hot-air temperature and the bonded state and the like. In order to maintain flexibility and secondary processability of the point-through-air nonwoven fabric 7 intended in the present application, it is preferred that the time to treat the web is as short as possible. The hot-air treatment of 0.1 second or more can provide a sufficient amount of heat with the fiber web 6 and the hot-air treatment of 10 seconds or less can suppress the influence of heat to the parts other than the hot-air treatment part. When the hot-air treatment is performed for more than 10 seconds, since the temperature of the endless belt with holes 1 itself becomes high, a side of the fiber web 6 which is in contact with the endless belt with holes 1 is wholly influenced by heat. Therefore, the surface of the point-through-air nonwoven fabric 7 tends to become hard and secondary processability tends to be impaired. As mentioned above, the hot-air penetration treatment time can be set by the MD length of the hot-air blowing face and the running speed.

As mentioned above, by using the processing apparatus for hot-air treatment nonwoven fabric of the invention, the point-through-air nonwoven fabric where the heat-bonded parts are formed in the spots of the fiber web can be produced. Moreover, according to the invention, since a web can be treated with hot air in a predetermined position of the belt, it is not necessary to place the whole apparatus under a heat atmosphere. Therefore, it is possible to produce a point-through-air nonwoven fabric where generation of a mixed part of the heat-bonded part and the non-heat-bonded part is suppressed. Furthermore, since the endless belt with holes and the endless belt for fiber conveyance are rotate to run at the same rate, the position of the holes of the endless belt with holes in contact with the fiber web do not shift and thus partial heat-bonding can be surely achieved.

The processing apparatus for hot-air treatment nonwoven fabric of the invention can also perform point-through-air processing of a sheet-like material. Examples of the sheet-like material in the present application include a material processed into a sheet-like one beforehand using a thermoplastic resin which may constitute the above web as a raw material. The kind of the constituting fiber and the degree of mixing and the like are not limited. Also, it is not limited to be a monolayer material or a laminated material. The bulk density is also not particularly limited. However, in the case where the bulk density is so high that the air permeability is impaired, the hot-air penetration processing becomes difficult, so that the bulk density is desirably 0.5 g/cm$^3$ or less. Moreover, the present apparatus can also perform point-through-air processing of a laminated material of the sheet-like material and the above web.

The point-through-air nonwoven fabric obtained by the processing apparatus of the invention can be made so as to have high bulkiness and high air permeability since the web and sheet-like material can be processed without pressing with a high pressure. In addition, by controlling the thickness, it is possible to arbitrarily control bulk density, air permeability and the like. Moreover, since only the hot-air treatment part is heat-bonded and the parts other than the hot-air treatment part are not so influenced by heat, it is possible to fulfill the functions of the synthetic fiber and the sheet-like material and further application to secondary processing is possible.

The above processing apparatus for hot-air treatment nonwoven fabric and processing method are effective for manufacturing a nonwoven fabric having all of bulkiness, flexibility, air permeability and strength. Furthermore, since the processing apparatus and the processing method enable the processing without losing properties of synthetic fiber, the nonwoven fabric processed by this method can be easily subjected to secondary processing utilizing properties of the synthetic fiber and sheet-like material.

Thus, since the nonwoven fabric obtained by the processing apparatus for hot-air treatment nonwoven fabric and processing method of the invention is excellent in bulkiness, flexibility, and air permeability; also has high-strength; and can utilize properties of the synthetic fiber constituting the web before processing and the sheet-like material before processing, the nonwoven fabric is suitably used for surface members for disposal diapers; surface members for hygienic materials such as members for sanitary goods; stretchable members for hygienic materials such as stretchable members for disposal diapers, stretchable members for diapers, stretchable members for sanitary goods, and stretchable members for diaper covers; stretchable tapes; adhesive plasters; stretchable members for clothes; interlining cloths for clothing materials; insulating materials and heat-keeping materials for clothing materials; protective clothing; hats and caps; masks; gloves; supporters; stretchable bandages; base fabrics for poultices; base fabrics for plaster materials; antislip base fabrics; vibration absorbers; fingerstalls; various filters such as air filters for clean rooms, blood filters, and filters for oily water separation; electret filters subjected to electret processing; separators; heat-insulating materials; coffee bags; food-packaging materials; various members for automobiles, such as ceiling skin material for automobiles, sound insulating materials, base materials, cushion materials, dust-proof materials, air cleaner materials, insulator skins, backing materials, adhesive nonwoven fabric sheets and door trim; various cleaning materials such as cleaning materials for copying machines; surface materials and back materials for carpets; agricultural winded cloths; wood drain materials; members for shoes; such as sport shoes skins; members for bags; industrial sealing materials; wiping materials; and articles such as sheets.

EXAMPLES

Furthermore, specific examples of the invention will be described in detail but the invention is not limited only to these Examples.

Example 1

Using a web comprising an eccentric sheath-core type conjugate short fiber where the sheath component comprised high-density polyethylene having a melting point of 130° C. and the core component comprised polypropylene having a melting point of 162° C.; fineness was 3 dtex/f; and cut length was 51 mm, a point-through-air nonwoven fabric where the fiber was partly heat-bonded was processed. In this regard, the web in Example 1 was continuously processed using a carding machine used in the previous step (not shown in figure) and then supplied to the processing apparatus for hot-air treatment nonwoven fabric of FIG. 1. The web has a unit weight of 30 g/m$^2$ and a width of 1 m.

The endless belt with holes 1 is made of stainless steel and holes are made all over the surface in a zigzag arrangement with a hole diameter of 2.5 mm and at the intervals of 5 mm. The open area ratio is 22.7%. The endless belt for fiber conveyance 3 is made of polyester and is a plain-woven one having a diameter of monofilament of 1 mm, a warp pitch of 2.5 mm, and a weft pitch of 2.5 mm. The open area ratio is 36%. The distance between the endless belt with holes 1 and the endless belt for fiber conveyance 3 was set so as to be 2 mm. In addition, the running rates of both belts were set at 50 m/minute.

The hot-air blowing face of the hot-air blowing duct 2 and the sucking face of the hot-air sucking duct 4 had an MD length of 1 m and a CD length of 1 m and were set so that the faces were opposed to each other. In a state without any web, the number of rotation of the hot-air circulating fan 8 and the heater temperature of the air heater 9 were set so that hot air supplied from the holes of the endless belt with holes 1 had a temperature of 140° C. and an air velocity of 2 m/second. The CV value of the air velocity at the hot-air blowing face was measured beforehand and was confirmed to be 7.3%. The sucking face of the cooling-air sucking duct 5 had an MD length of 1 m and the CD length was set at 1 m that is equal to the blowing face of the hot-air blowing duct 2 at the upstream side. Moreover, the number of rotation of the cooling-air exhaust fan 10 was set so that the sucking air velocity at the opposed side of the net-like belt in contact with the sucking face of the cooling-air sucking duct 5 was 2 m/second.

After the conditions of the apparatus were set as above, the carding machine and the processing apparatus for hot-air treatment nonwoven fabric were run and the fiber web 6 was supplied to the processing apparatus for hot-air treatment nonwoven fabric of FIG. 1 from the left. The web 6 was run at a running rate of 50 m/minute from left to right direction with being held between the endless belt with holes 1 and the endless belt for fiber conveyance 3 without shifting from the belts to continuously produce the point-through-air nonwoven fabric 7 where the parts treated with hot air were heat-bonded. In this regard, the hot-air penetration treatment time is 1.2 second.

Figure 2:
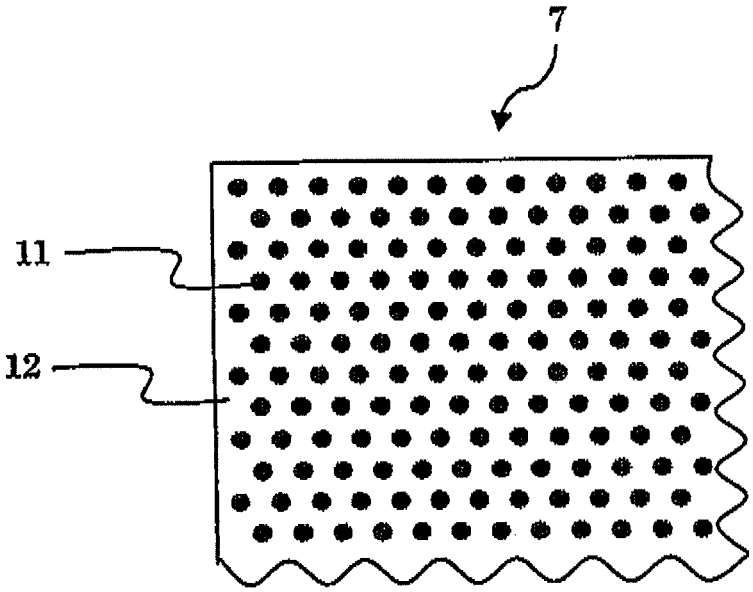
FIG. 2 is a whole plane view of the nonwoven fabric obtained by the processing method of Example 1 or 2.
Figure 3:
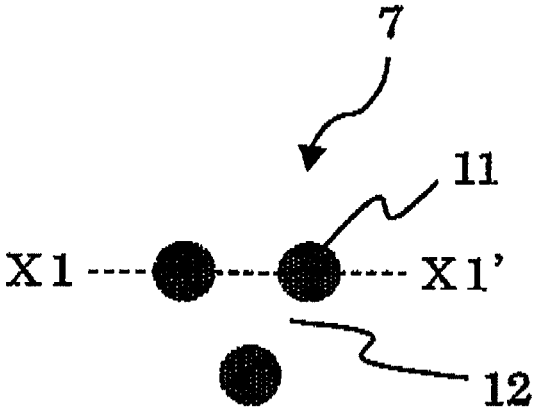
FIG. 3 is a partial enlarged view of FIG. 2.
Figure 4:
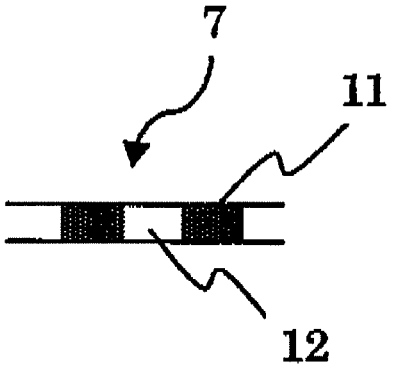
FIG. 4 is a X1-X1' cross-sectional view of Example 1 of FIG. 3.

Although the processing apparatus run continuously for about 6 hours, it could run without generating problems on the apparatus, problems on running and problems on products. The produced point-through-air nonwoven fabric 7 kept at a constant thickness of about 2 mm, had the heat-bonded part 11 and the non-heat-bonded part 12 as shown in FIGS. 2, 3, and 4 and also had both of bulkiness and flexibility.

Example 2

From a bilayer web which comprised a web having a unit weight of 20 g/m$^2$ as the upper layer part comprising a sheath-core type conjugate short fiber where the sheath component comprised linear low-density polyethylene having a melting point of 100° C. and the core component comprised polypropylene having a melting point of 162° C.; fineness was 2 dtex/f; and cut length was 51 mm, and a web having a unit weight of 10 g/m$^2$ as the lower layer part and comprising a side-by-side type conjugate short fiber wherein the side-by-side type conjugate short fiber comprised ethylene-propylene copolymer having a melting point of 130° C. and polypropylene having a melting point of 160° C.; fineness was 3 dtex/f; and cut length was 51 mm, a point-through-air nonwoven fabric where only the conjugate fiber constituting the upper layer part was partly heat-bonded was processed. In this regard, the bilayer web in Example 2 was continuously processed using two carding machines which were arranged sequentially and used in the previous step (not shown in figure) and then supplied to the processing apparatus for hot-air treatment nonwoven fabric of FIG. 1. The bilayer web has a unit weight of 30 g/m$^2$ and a width of 1 m.

The same processing apparatus for hot-air treatment nonwoven fabric as Example 1 was used. However, the processing conditions were as follows. The distance between the endless belt with holes 1 and the endless belt for fiber conveyance 3 was set so as to be 1 mm. The running rate of both belts was set at 50 m/minute which was the same as in Example 1. The temperature of hot air supplied from the holes of the endless belt with holes 1 was set at 120° C. in the absence of any web and an air velocity was set at 2 m/second. The sucking air velocity of the cooling air was set at 2 m/second.

After the conditions of the apparatus were set as above, the carding machines and the processing apparatus for hot-air treatment nonwoven fabric were run and the fiber web 6 was supplied to the processing apparatus for hot-air treatment nonwoven fabric of FIG. 1 from the left. The web 6 was run at a running rate of 50 m/minute from the left to right direction with being held between the endless belt with holes 1 and the endless belt for fiber conveyance 3 without shifting from the belts to continuously produce a point-through-air nonwoven fabric 7 where only the upper layer part of the part treated with hot air was heat-bonded.

Figure 5:
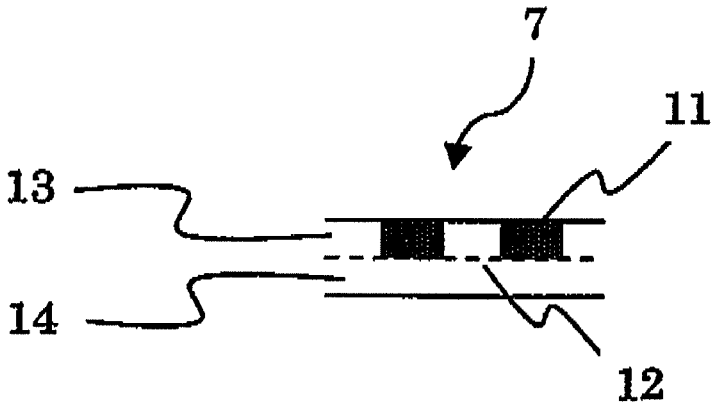
FIG. 5 is a X1-X1' cross-sectional view of Example 2 of FIG. 3.
Figure 6:
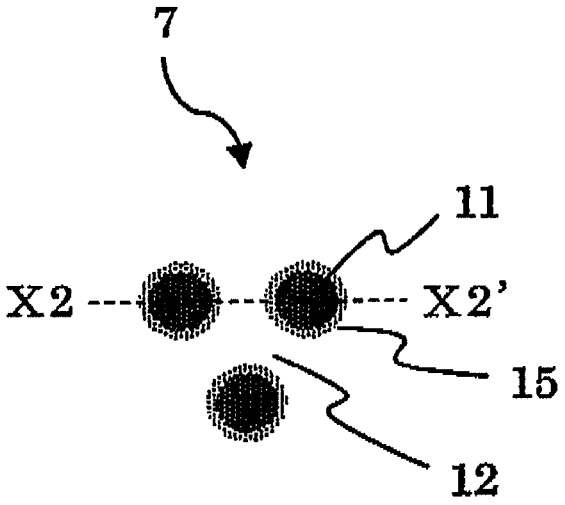
FIG. 6 is one example showing a bonded state of a nonwoven fabric.
Figure 7:
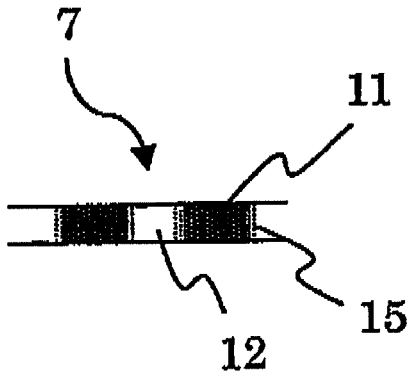
FIG. 7 is a X2-X2' cross-sectional view of FIG. 6.
Figure 8:
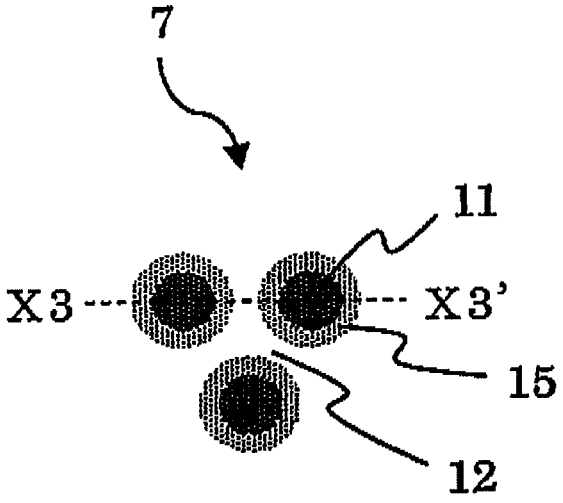
FIG. 8 is one example showing a bonded state of a nonwoven fabric.
Figure 9:
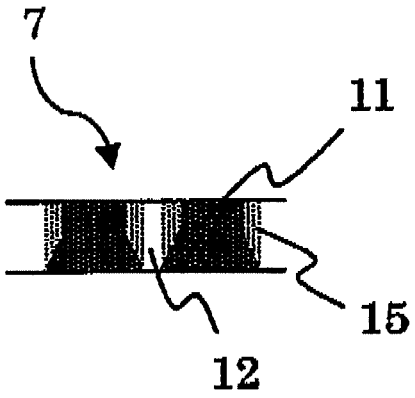
FIG. 9 is a X3-X3' cross-sectional view of FIG. 8.
Figure 10:
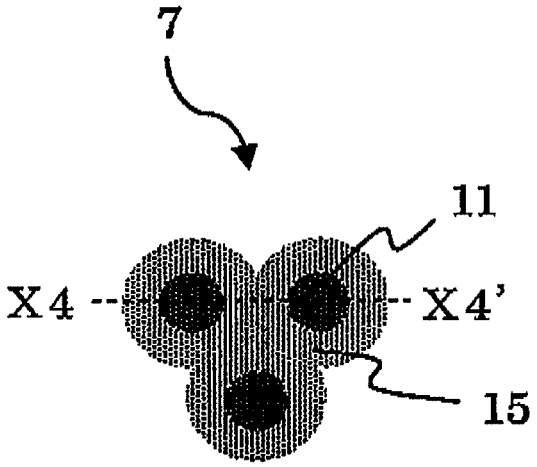
FIG. 10 is one example showing a bonded state of a nonwoven fabric.
Figure 11:
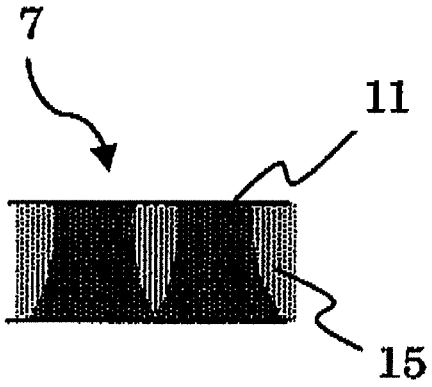
FIG. 11 is a X4-X4' cross-sectional view of FIG. 10.

Although the apparatus run continuously for 6 hours, it could run without generating problems on the apparatus, problems on running and problems on products. The produced point-through-air nonwoven fabric 7 kept at a constant thickness of about 1 mm and had the heat-bonded part 11 and the non-heat-bonded part 12 in the upper layer part 13 and the wholly non-heat-bonded part 12 in the lower layer part 14 as shown in FIGS. 2, 3, and 5. However, fine crimps of the constituting side-by-side type conjugate fiber were shown at the parts through which hot air penetrated. The point-through-air nonwoven fabric 7 was thermally treated at 120° C. using a floating drier (not shown in the figure) in the later step. Although the side-by-side type conjugate fiber at the non-heat-bonded part 12 of the lower layer part was finely crimped, the shrinking property almost unchanged. Thus, by making full use of the processing conditions of the floating drier, the nonwoven fabric was subjected to heat-shrinking processing so as to give a MD shrinking ratio of 50% and a CD shrinking ratio of 40%. The nonwoven fabric had a unit weight of 100 g/m$^2$ and a thickness of about 4 mm and had both of bulkiness and flexibility.

While the invention has been described in detail and with reference to specific embodiments thereof, it will be apparent to one skilled in the art that various changes and modifications can be made therein without departing from the spirit and scope thereof.

This application is based on Japanese application No. 2010-086394 filed on Apr. 2, 2010, the entire contents of which are incorporated hereinto by reference. All references cited herein are incorporated in their entirety.

What is claimed is:

1. A processing apparatus for hot-air treatment of nonwoven fabric, comprising:

a rotating running endless belt provided with a plurality of holes;

a hot-air blowing apparatus for blowing hot air from an internal side of the endless belt with holes toward an outer side thereof;

an endless belt for fiber conveyance arranged so as to oppose the outer side of the endless belt with holes, wherein the endless belt for fiber conveyance is positioned opposite the hot-air blowing apparatus and the endless belt for fiber conveyance is rotatable while at a hot-air treatment part so that hot-air from the hot-air blowing apparatus passes therethrough to form spots in the fiber web; and a cooling-air sucking system without an air-forcibly cooling apparatus and including a cooling-air sucking duct located at a position immediately near a downstream part of the hot-air treatment part and at an internal side of the endless belt for fiber conveyance such that atmospheric air penetrates through the endless belt with holes due to suction provided by the cooling-air sucking duct, wherein heat-bonded parts are formed at the spots in the fiber web, and the heat-bonded parts correspond to the holes in the endless belt with holes, wherein the endless belt with holes and the endless belt for fiber conveyance are spaced at a distance that is freely controllable in a range of 0.1 to 20 mm, and wherein a percentage of open area formed by the holes in the endless belt with holes relative to the total area of the endless belt with holes is 60% or less.

2. The processing apparatus for hot-air treatment of nonwoven fabric according to claim 1, further comprising a hot-air sucking apparatus for sucking a part or all of the hot air supplied from the hot-air blowing apparatus, the hot-air sucking apparatus being disposed on an internal side of the endless belt for fiber conveyance.

3. The processing apparatus for hot-air treatment of nonwoven fabric according to claim 1, wherein a percentage of open area formed by the holes in the endless belt with holes relative to the total area of the endless belt is 10 to 40%.

4. The processing apparatus for hot-air treatment of nonwoven fabric process according to claim 1, wherein the hot-air blowing apparatus has a CV value of hot-air blowing rate of 12% or less.

5. The processing apparatus for hot-air treatment of nonwoven fabric according to claim 1, wherein a distance between the endless belt with holes and a hot-air blowing face of the hot-air blowing apparatus is 5 mm or less.

6. The processing apparatus for hot-air treatment of nonwoven fabric, according to claim 1, wherein the endless belt with holes is a continuous belt formed by connecting opposite end parts of a perforated plate material.

7. The processing apparatus for hot-air treatment of nonwoven fabric, according to claim 6, wherein the endless belt with holes has a thickness in a range of 0.3 mm to 2 mm.

8. The processing apparatus for hot-air treatment of nonwoven fabric, according to claim 1, wherein the cooling-air sucking system consists essentially of the cooling-air sucking duct and an exhaust fan having an air sucking port connected to an air outlet of the cooling-air sucking duct.

* * * * *